US008010000B2

(12) United States Patent
Goto

(10) Patent No.: US 8,010,000 B2
(45) Date of Patent: Aug. 30, 2011

(54) IMAGE FORMING APPARATUS FOR USE IN CONTROLLING IMAGE MAGNIFICATION

(75) Inventor: Tatsuya Goto, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 442 days.

(21) Appl. No.: 12/170,188

(22) Filed: Jul. 9, 2008

(65) Prior Publication Data

US 2009/0034996 A1 Feb. 5, 2009

(30) Foreign Application Priority Data

Jul. 10, 2007 (JP) ..... 2007-180974

(51) Int. Cl.
*G03G 15/00* (2006.01)
*G03G 15/04* (2006.01)
*G03G 15/041* (2006.01)
*G03G 15/043* (2006.01)

(52) U.S. Cl. ..... 399/44; 399/51; 399/177; 399/196; 399/197; 399/198

(58) Field of Classification Search ..... 399/44, 399/156, 177, 196–198
See application file for complete search history.

(56) References Cited

U.S. PATENT DOCUMENTS

| | | | | |
|---|---|---|---|---|
| 5,828,925 | A * | 10/1998 | Yoshizawa | 399/39 |
| 5,890,043 | A | 3/1999 | Uehara | |
| 7,133,056 | B2 * | 11/2006 | Tanaka et al. | 347/116 |
| 2004/0101332 | A1 * | 5/2004 | Sohmiya et al. | 399/307 |
| 2005/0286920 | A1 * | 12/2005 | Baba et al. | 399/69 |

FOREIGN PATENT DOCUMENTS

| | | | |
|---|---|---|---|
| JP | 06-332338 | A | 12/1994 |
| JP | 10-63121 | A | 3/1998 |
| JP | 2005-31312 | A | 2/2005 |

* cited by examiner

*Primary Examiner* — David M Gray
*Assistant Examiner* — David Bolduc
(74) *Attorney, Agent, or Firm* — Canon U.S.A., Inc. IP Division

(57) ABSTRACT

An image forming apparatus includes a light source unit, an image carrier on which a latent image is formed by a light beam emitted from a light source, a developing unit configured to develop a latent image formed on the image carrier using a toner, an intermediate transfer unit on which a toner image developed by the developing unit is transferred, a heating unit configured to heat the intermediate transfer unit on which a toner image is transferred, a fixing unit configured to fix the toner image heated by the heating unit on a recording medium, a temperature detection unit configured to detect temperature of the intermediate transfer unit, and a control unit configured to control a magnification of a latent image to be formed on the image carrier according to a detection result of the temperature detection unit.

6 Claims, 10 Drawing Sheets

IMAGE FORMING APPARATUS FOR USE IN CONTROLLING IMAGE MAGNIFICATION

BACKGROUND OF THE INVENTION

1. Field of the Invention

The present invention relates to an electrophotographic image forming apparatus, and a method for forming the image. In particular, the present invention relates to the image forming apparatus using a simultaneous transfer and fixing system in which a toner image formed on an image carrier is heated and pressed to be fixed on a sheet simultaneously with a transfer of the image via an intermediate transfer member.

2. Description of the Related Art

A conventional image forming apparatus uses an electrophotographic system to form a favorable color image such as described below.

Such an image forming apparatus includes the same number of image carriers (i.e., photosensitive members) as kinds of color required in image formation, a charging unit disposed around the image carriers, an exposure unit, and a developing unit. The image forming apparatus superimposes and transfers (a primary transfer) single-color toner images formed on each image carriers onto the intermediate transfer member or a sheet to form a color image.

In general, an image forming apparatus using an intermediate transfer member electrostatically transfers the toner image from the intermediate transfer member onto a sheet. However, sometimes a problem arises when a multi-color image formed on the intermediate transfer member is transferred onto the sheet, i.e., when performing a secondary transfer process.

In the secondary transfer, a toner image on an intermediate transfer member is transferred onto various types of sheets. If a toner image is to be transferred onto a sheet whose surface is greatly uneven, a gap between the intermediate transfer member and the sheet at the transfer position becomes also uneven, so that a transfer electric field is distorted. As a result, the toner is dispersed and the transfer is not correctly performed.

Further, since an amount of moisture in a sheet greatly affects transferability, image formation may not be stably performed due to environmental changes such as a change in humidity.

Further, toner images of a plurality of colors are superimposed and formed on an intermediate transfer member. Therefore, for example, while a toner image of three or more layers is formed on one position, a toner image of one layer may be formed on another position. Consequently, a thickness of the toner image varies according to a position, or a charge amount for each color image becomes uneven. As a result, it is difficult to uniformly apply an electric field on the toner image, so that an abnormal image can be generated on an intermediate transfer member where a toner image is thick or thin, or where a toner charge amount is large or small.

To address the above-described problem, Japanese Patent Application Laid-Open No. 10-63121 discusses an image forming apparatus using a simultaneous transfer and fixing system. Such an image forming apparatus transfers a toner image formed on an image carrier onto an intermediate transfer member and heat-fuses the toner image formed on the intermediate transfer member. The heat-fused toner image is then pressed onto a sheet to be fixed simultaneously with the transfer.

The heat-fused toner image of the image forming apparatus discussed in Japanese Patent Application Laid-Open No. 10-63121 shows a more favorable transferability as compared to an electrostatic transfer system. The transferability is more favorable owing to a difference of surface energies between the intermediate transfer member and the sheet, a difference of effective contact areas of transferred toner on both sides, and adhesive force of the fused toner.

Moreover, Japanese Patent Application Laid-Open No. 2005-31312 discusses an image forming apparatus which transfers a toner image formed on an image carrier onto a first intermediate transfer member (i.e., a primary transfer), and transfers the toner image on the first intermediate transfer member onto a second intermediate transfer member (i.e., a secondary transfer). The image forming apparatus then heats and presses the toner image formed on the second intermediate transfer member to transfer and fix the image on a sheet.

The image forming apparatus discussed in Japanese Patent Application Laid-Open No. 2005-31312 includes a transfer member contacting/separating unit that press-contacts and separates the first intermediate transfer member and the second intermediate transfer member. Consequently, a temperature rise in the image carrier caused by the intermediate transfer members is controlled, and image degradation due to a temperature rise is reduced.

On the other hand, a fixing apparatus generally uses as a heat source a heating member disposed in a longitudinal direction (i.e., direction of a roller shaft) inside a heating roller. A surface temperature of the heating roller is controlled to be at a desired temperature by measuring a surface temperature of the heating roller and controlling an ON/OFF state of the heating member according to the measurement result.

However, the surface temperature of the heating roller changes due to various causes, so that it is difficult to accurately maintain a constant surface temperature.

For example, when a sheet is passed through a fixing apparatus, the sheet takes off heat and the temperature on a surface of a heating roller becomes uneven. In particular, if short sheets are continuously passed through the fixing apparatus in the longitudinal direction of the heating roller, heat is taken off only from a portion where the sheets pass, thereby generating a difference in temperature distribution in the longitudinal direction of the heating roller. As a result, an edge temperature rises in the heating roller, i.e., a temperature greatly rises at a portion of the heating roller where the sheets do not pass. The edge temperature rise may lead to image degradation such as high temperature offset or uneven brightness.

To solve such a problem, Japanese Patent Application Laid-Open No. 06-332338 discusses a technique by which a heating member inside a heating roller is segmented in a longitudinal direction. Power distribution of the segmented heating member is switched and controlled respectively, so that the edge temperature rise and temperature unevenness can be reduced.

A temperature unevenness can also be generated in a transfer-fixing portion of the image forming apparatuses discussed in Japanese Patent Application Laid-Open No. 10-63121 and No. 2005-31312. In such a case, even if technique discussed in Japanese Patent Application Laid-Open No. 06-332338 reduces the temperature unevenness to a level which does not lead to image degradation, there arises a problem as described below.

As long as there is a temperature difference in the transfer-fixing portion of the image forming apparatus, an intermediate transfer member expands and contracts due to a difference in a heat expansion rate. As a result, magnification of a toner image formed on the intermediate transfer member changes according to expansion/contraction of the intermediate transfer member. Such a toner image is then directly transferred and fixed onto a sheet, so that a departure in image magnification occurs on the sheet.

SUMMARY OF THE INVENTION

The present invention is directed to an image forming apparatus in which a stable output image can be obtained by preventing a departure of image magnification on a sheet, even in a case where there is temperature unevenness in a transfer-fixing portion.

According to an aspect of the present invention, an image forming apparatus includes a light source unit, an image carrier on which a latent image is formed by a light beam emitted from a light source, a developing unit configured to develop a latent image formed on the image carrier using a toner, an intermediate transfer unit on which a toner image developed by the developing unit is transferred, a heating unit configured to heat the intermediate transfer unit on which a toner image is transferred, a fixing unit configured to fix the toner image heated by the heating unit on a recording medium, a temperature detection unit configured to detect temperature of the intermediate transfer unit, and a control unit configured to control a magnification of a latent image to be formed on the image carrier according to a detection result of the temperature detection unit.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DETAILED DESCRIPTION OF THE EMBODIMENTS

Various exemplary embodiments, features, and aspects of the invention will be described in detail below with reference to the drawings.

First Exemplary Embodiment

Figure 1:
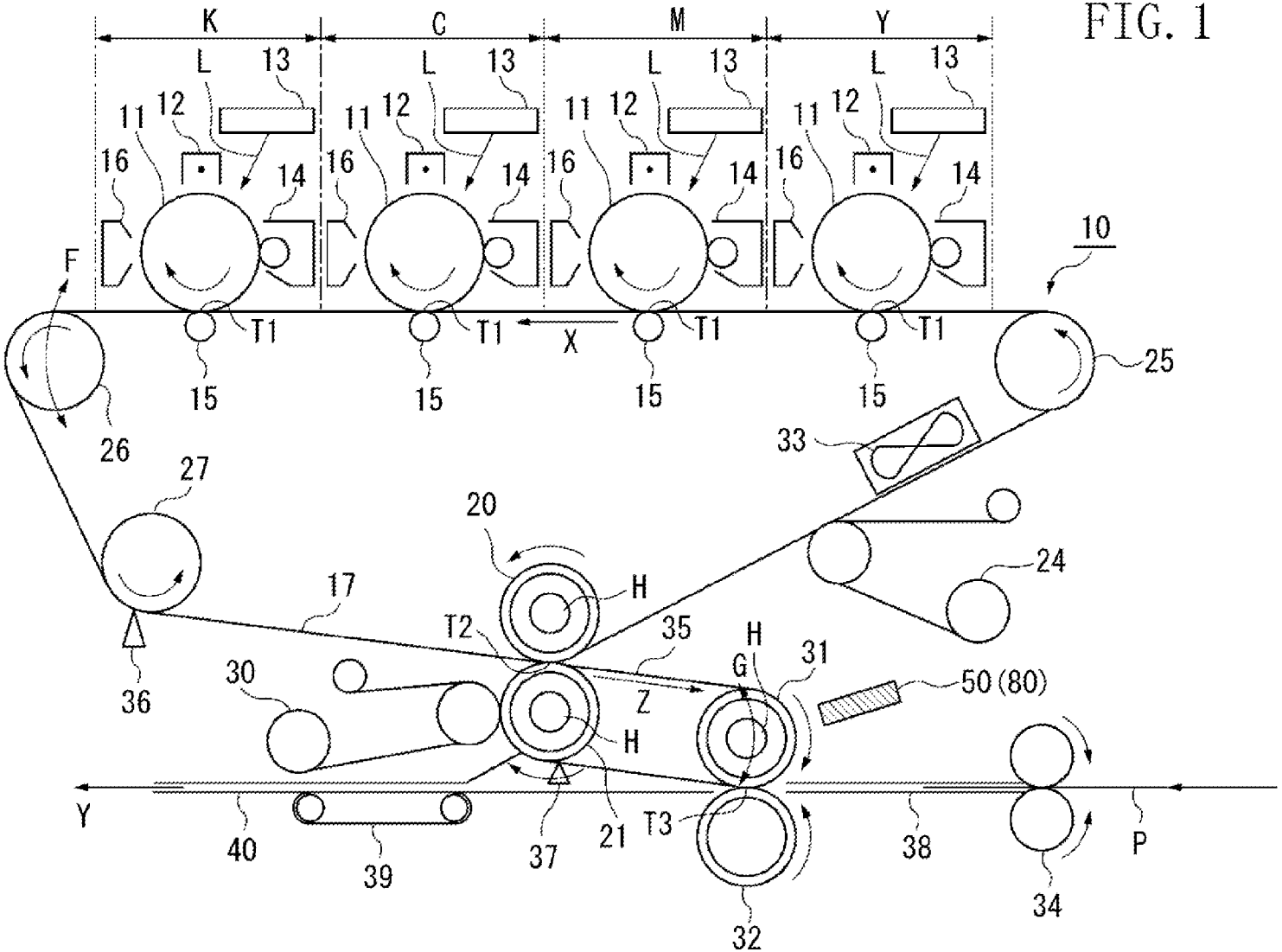
FIG. 1 illustrates a configuration of an image forming apparatus according to an exemplary embodiment of the present invention.

FIG. 1 illustrates a configuration of an image forming apparatus according to an exemplary embodiment of the present invention. Referring to FIG. 1, an image forming apparatus 10 includes a first, second, third, and fourth toner image forming units (hereinafter, referred to as image forming units) Y, M, C, K, a first intermediate transfer member 17, and a second intermediate transfer member 35.

The image forming units Y, M, C, K are basically a similar mechanism for performing an electrophotographic image forming process. Each of the image forming units Y, M, C, K includes a drum type electrophotographic photosensitive member (hereinafter, referred to as a photosensitive member) 11. The photosensitive member 11 of the image forming units is an image carrier which is driven to rotate at a predetermined circumferential velocity in a direction of an arrow illustrated in FIG. 1.

A charging device 12, an exposure device 13, a developing device 14, a primary transfer device 15, and a cleaning unit 16 are disposed around the photosensitive member 11.

The charging device 12 uniformly charges a surface of the photosensitive member 11 to a predetermined polarity and voltage. The exposure device (i.e., an optical scanning unit) 13 is configured of a laser scanner or a light-emitting diode (LED) array. The exposure device 13 scans with a light beam L using a polygon mirror (i.e., a rotating polyhedron, not illustrated) that is rotated according to an image writing clock, to form an electrostatic latent image (i.e., a latent image) on a charged surface of the photosensitive member 11.

The developing device 14 develops the electrostatic latent image formed on the photosensitive member 11 as a toner image. The primary transfer device 15 transfers the toner image formed on the photosensitive member 11 onto the first intermediate transfer member 17 at the primary transfer portion T1. The cleaning unit 16 cleans the surface of the photosensitive member 11 after the toner image is transferred onto the first intermediate transfer member 17.

The developing device 14 of the image forming unit Y contains an yellow toner as a developer and thus forms a yellow toner image on the photosensitive member 11. The developing device 14 of the image forming unit M contains a magenta toner as a developer and forms a magenta toner image on the photosensitive member 11.

The developing device 14 of the image forming unit C contains a cyan toner as a developer and forms a cyan toner image on the photosensitive member 11. The developing device 14 of the image forming unit B contains a black toner as a developer and forms a black toner image on the photosensitive member 11.

According to the present exemplary embodiment, an endless belt member is used as the first intermediate transfer member 17 which is stretched around a driving roller 25, a steering roller 26, an assist roller 27, and a heating roller 20. The portion of the first intermediate transfer member 17 stretched between the driving roller 25 and the steering roller 26 is disposed along the photosensitive members 11 of the image forming units Y, M, C, K.

A pressing unit (not illustrated) applies pressure on the steering roller 26, so that the steering roller 26 applies a constant tensile force on the first intermediate transfer member 17. The steering roller 26 displaces its axial edges in directions opposite to each other as indicated by an arrow F illustrated in FIG. 1. Consequently, the steering roller 26 is displaced in a twisting direction relative to the driving roller 25.

An edge detection unit 36 which detects an edge in a width direction of the first intermediate transfer member 17 is disposed downstream of the steering roller 26 in a moving direction of the first intermediate transfer member 17. A displacement amount of the steering roller 26 is controlled based on the position and moving speed of the first intermediate transfer member 17 in the width direction that are detected by the edge detection unit 36. As a result, a shifting of the first intermediate transfer member 17 in the width direction is controlled.

The first intermediate transfer member 17 is rotatably driven by the driving roller 25 being driven in a direction indicated by an arrow X illustrated in FIG. 1. The first intermediate transfer member 17 is rotated at almost the same circumferential velocity as the circumferential rotational velocity of the photosensitive member 11. A surface of the driving roller 25 is coated with conductive ethylene-propylene diene monomer (EPDM) in a thickness of 0.5 mm.

According to the present exemplary embodiment, an endless belt member is used as the second intermediate transfer member 35 which is stretched around a secondary transfer-pressing roller 21 and a transfer-fixing-heating roller 31.

The transfer-fixing-heating roller 31 receives pressure from a pressing unit (no illustrated) and applies a constant tensile force on the second intermediate transfer member 35. Further, the transfer-fixing-heating roller 31 displaces axial edges of the transfer-fixing-heating roller 31 in directions opposite to each other as indicated by an arrow G. Consequently, the transfer-fixing-heating roller 31 is displaced in a twisting direction relative to the secondary transfer-pressing roller 21.

An edge detection unit 37 is disposed downstream of the transfer-fixing-heating roller 31 in a moving direction of the second intermediate transfer member 35. A displacement amount of the transfer-fixing-heating roller 31 is controlled based on the position and moving speed of the second intermediate transfer member 35 in the width direction that are detected by the edge detection unit 37. As a result, a shifting of the second intermediate transfer member 35 in the width direction is controlled.

A pressing unit (not illustrated) applies pressure on the secondary transfer-pressing roller 21. The secondary transfer-pressing roller 21 and the pressing unit are configured such that the pressure distribution at a transfer-fixing portion T3 in a width direction does not become uneven by following a displacement of the transfer-fixing-heating roller 31 in a twisting direction.

The second intermediate transfer member 35 is rotatably driven by the secondary transfer-pressing roller 21 being driven in a direction indicated by an arrow Z illustrated in FIG. 1. The second intermediate transfer member 35 is rotatably driven at almost the same circumferential velocity as the circumferential rotational velocity of the first intermediate transfer member 17.

The belt members used by the first intermediate transfer member 17 and the second intermediate transfer member 35 are, for example, a two-layer belt consisting of a base layer and a surface layer, or a single-layered belt consisting of only a base layer.

Polyimide (PI), polyether ketone (PEEK), polyamide-imide (PAI), polyether sulphone (PES), or polyethernitrile (PEN) is used as the base layer. Polyimide is favorable in consideration of heat resistance and machine strength.

In the present exemplary embodiment, a polyimide film in a thickness of 50 μm in which carbon black is distributed and subjected to a semiconduction electrification treatment is used as the base layer of the first intermediate transfer member 17 and the second intermediate transfer member 35. Further, a semi conductive silicon rubber having a rubber hardness of 50° and a thickness of 300 μm is used as the surface layer of the second intermediate transfer member 35.

The above-described structure realizes an adequate adhesiveness between the first intermediate transfer member 17 and the second intermediate transfer member 35 when a toner image on the first intermediate transfer member 17 is secondary transferred to the second intermediate transfer member 35 at the secondary transfer portion T2.

Further, the above-described structure realizes an adequate adhesiveness between the second intermediate member 35 and the sheet when a toner image on the second intermediate transfer member 35 is simultaneously transferred and fixed onto a sheet at the transfer-fixing portion T3. In addition, the above-described structure realizes a favorable mold release of the toner from the second intermediate transfer member 35 and heat resistance of the first intermediate transfer member 17 and the second intermediate transfer member 35.

The first intermediate transfer member 17 has a single-layer structure consisting of only a base layer. The transfer member 17 has this structure in consideration of a mold release characteristic of the toner when the toner image on the first intermediate transfer member 17 is secondary transferred to the second intermediate transfer member 35.

A surface roughness is set on each of the upper sides (i.e., external surface) of the first intermediate transfer member 17 and the second intermediate transfer member 35 such that the effective contact areas of the toner image with the first intermediate transfer member 17 and the second intermediate transfer member 35 satisfies a relation, "second intermediate transfer member>first intermediate transfer member." The effective contact areas refer to a portion in which the toner image fused at the secondary transfer portion T2 contacts the second intermediate transfer member 35 and the first intermediate transfer member 17.

Further, a volume resistivity of the base layer is adjusted to have a resistance of 108 to 1011 Ω·cm, and a volume resistivity of the surface layer is adjusted to have a resistance of 1013 to 1015 Ω·cm. This adjustment is made in consideration of transferability of the toner image formed on the photosensitive member 11 onto the first intermediate transfer member 17.

In the present exemplary embodiment, each primary transfer device 15 of the image forming units Y, M, C, K is a transfer roller. Each primary transfer device 15 press-contacts the photosensitive member 11 across the first intermediate transfer member 17. The primary transfer device 15 thus forms a primary transfer portion (nip portion) T1 between the photosensitive member 11 and the first intermediate transfer member 17.

A pressing unit (not illustrated) causes the secondary transfer-pressing roller 21 to press-contact the secondary transfer-heating roller 20 via the first intermediate transfer member 17 and the second intermediate transfer member 35. The secondary transfer-pressing roller 21 thus forms the secondary transfer portion (nip portion) T2 between the first intermediate transfer member 17 and the second intermediate transfer member 35. Further, the pressing unit includes a pressure release unit, so that a nip at the secondary transfer portion T2 can be released at a desired timing.

The transfer-fixing-pressing roller 32 press-contacts the transfer-fixing-heating roller 31 via the second intermediate transfer member 35. The transfer-fixing-pressing roller 32 thus forms a transfer-fixing portion (nip portion) T3 with the second intermediate transfer member 35.

The secondary transfer-heating roller 20, the secondary transfer-pressing roller 21, the transfer-fixing-heating roller 31, and the transfer-fixing-heating roller 32 can be each formed of a metal roller which is covered with a heat-resistant elastic layer such as silicon rubber. The present exemplary embodiment uses a roller that is a hollow cylinder in a thickness of 2 mm. The cylinder is laminated by a silicon rubber having 40° in JISA hardness and thickness of 2 mm, and the outer diameter is 50 mm.

A halogen lamp H is disposed as a heating source inside each of the secondary transfer-heating roller 20, the secondary transfer-pressing roller 21, and the transfer-fixing-eating roller 31. A nip width of the transfer-fixing portion T3 is set at 7 mm to 10 mm, and pressure is set at 2.4 to $3.9\times10^5$ Pa.

A cooling fan unit 33 is disposed at the reverse side of the first intermediate transfer member 17, between the secondary transfer-heating roller 20 and the driving roller 25.

Further, a web type cleaning unit 24 which cleans an upper surface of the first intermediate transfer member 17 is disposed on the upper side of the first intermediate transfer member 17 between the secondary transfer-heating roller 20 and the driving roller 25. A no woven fabric which is a polyester fiber in thickness of 80 μm is used as a web of the cleaning unit 24.

A web-type cleaning unit 30 which cleans an upper surface of the second intermediate transfer member 35 is disposed near the secondary transfer-pressing roller 21. A no woven fabric which is a polyester fiber in thickness of 80 μm is used as a web of the cleaning unit 30.

A conveying roller pair 34 is rotatably driven by a driving unit (not illustrated) and conveys a sheet P fed by a paper feeding device (not illustrated) to the transfer-fixing portion T3. A pre-transfer-fixing guide 38 guides a leading edge of the sheet P conveyed by the conveying roller pair 34 to the transfer-fixing portion T3.

A conveying belt unit 39 is rotatably driven by a driving unit (not illustrated). A fan disposed inside a conveying belt unit 39 causes the sheet P to adhere to a belt member stretched around the conveying belt unit 39 by wind power. The conveying belt unit 39 thus conveys the sheet P adhering to the belt member on which a toner image is transferred and fixed at the transfer-fixing portion T3, in a direction indicated by an arrow Y illustrated in FIG. 1. A post-transfer-fixing guide 40 guides the leading edge of the sheet P conveyed by the conveying belt unit 39.

A full-color image forming process performed by the above-described image forming apparatus will be described below.

The image forming units Y, M, C, K are sequentially driven in synchronization with image formation. The first intermediate transfer member 17 and the second intermediate transfer member 35 are also rotatably driven.

Toner images of each color formed on the photosensitive member 11 of the image forming units Y, M, C, K are then sequentially superimposed and transferred on the first intermediate transfer member 17 at the primary transfer portion T1. An unfixed full-color toner image is thus formed on the first intermediate transfer member 17.

The present exemplary embodiment uses a negative toner whose normal charging polarity is negative. A bias-applying power source (not illustrated) applies a positive transfer bias, which is an opposite polarity from a charging polarity of the normally charged toner, on each transfer roller, i.e., the primary transfer device 15. The toner image is thus electrostatic-transferred from the photosensitive member 11 to the first intermediate transfer member 17 at the primary transfer portion T1.

The unfixed full-color toner image formed on the first intermediate transfer member 17 reaches the secondary transfer portion T2. The full-color toner image is then heat-fused by the secondary transfer-heating roller 20 and the secondary transfer-pressing roller 21.

As described above, in the present exemplary embodiment, the halogen lamp H is disposed inside the secondary transfer-heating roller 20 and the secondary transfer-pressing roller 21 as a heating source. A surface of the secondary transfer-heating roller 20 is controlled to be between 110° C. and 120° C. by a temperature control circuit (not illustrated). Similarly, a surface of the secondary transfer-pressing roller 21 is controlled to be between 130° C. and 150° C.

The full-color toner image which is heat-fused at the secondary transfer portion T2 is heat-transferred from the first intermediate transfer member 17 to the second intermediate transfer member 35. After the full-color toner image is secondary-transferred to the second intermediate transfer member 35, the surface of the first intermediate transfer member 17 is cleaned by the web of the cleaning unit 24 and repeatedly used in image formation.

Further, the cooling fan unit 33 cools the first intermediate transfer member 17 after the full-color toner image is secondary-transferred to the second intermediate transfer member 35. As a result, temperature at the primary transfer portion T1 of each of the image forming units Y, M, C, K becomes 40° C. or lower.

When the full-color toner image formed on the second intermediate transfer member 35 reaches the transfer-fixing portion T3, the full-color toner image is heat-fused by the transfer-fixing-heating roller 31. As described above, in the present exemplary embodiment, the halogen lamp H is disposed inside the transfer-fixing-heating roller 31 as a heating source. A surface of the transfer-fixing-heating roller 31 is controlled to be between 150° C. and 180° C. by a temperature control circuit (not illustrated).

A sheet P is conveyed from the conveying roller 34 to the transfer-fixing portion T3 at a predetermined control timing. The transfer-fixing-heating roller 31 and the transfer-fixing-pressing roller 32 then simultaneously tertiary-transfers and heats, presses, and fixes the heat-fused full-color toner image on the sheet P.

The transfer-fixing-heating roller 31 curvature-separates the sheet P on which the full-color toner image is tertiary transferred at the transfer-fixing portion T, from the surface of the secondary intermediate member 35. The sheet is then conveyed adhering to the conveying belt unit 39, and ejected in the direction indicated by the arrow Y illustrated in FIG. 1, via the post-transfer fixing guide 40. The web of the cleaning unit 30 cleans the surface of the second intermediate transfer member 35 after the sheet is separated, and the surface is repeatedly used in the secondary transfer.

As described above, according to the present exemplary embodiment, the second intermediate transfer member 35 includes a silicon rubber surface layer. Consequently, even in a case where a toner image is to be transferred and fixed on a sheet whose surface is markedly uneven such as an emboss paper, the silicon rubber surface layer changes shape and tightly adheres to the uneven surface of the sheet. Therefore, a favorable transfer can be realized.

Further, since the first intermediate transfer member 17 has a single-layer structure configured of a polyimide film, the heat capacity of the first intermediate transfer member 17 is small. Accordingly, the first intermediate transfer member 17 can be easily cooled to a desired temperature by the cooling fan unit 33, even in a case where the first intermediate transfer member 17 is heated at the secondary transfer portion T2. Therefore, the cooling fan unit 33 can be downsized, and the driving power of the cooling fan unit 33 can be reduced.

Further, a heat amount required for heating the first intermediate transfer member 17 at the secondary transfer portion T2 is small. Thus, energy consumption for the heating can be reduced. Furthermore, the time required for heating the first intermediate transfer member 17 can be shortened, so that the image forming process can be performed at a higher speed.

Further, when a leading edge of the sheet P enters the transfer-fixing portion T3 or when a trailing edge of the sheet P leaves the fixing portion T3, a circumferential velocity of the second intermediate transfer member 35 momentarily changes due to a load change. However, since the first intermediate transfer member 17 and the secondary intermediate transfer member 35 are driven by separate motors, the velocity change of the second intermediate transfer member 35 cannot be easily transmitted to the primary transfer portion T1. Therefore, displacement in a position of color toner image can be prevented when the toner images are transferred to the first intermediate transfer member 17 at the primary transfer portion T1, leading to prevention of image degradation.

Further, since the secondary intermediate transfer member 35 is a belt member, temperatures at the secondary transfer portion T2 and the transfer-fixing portion T3 can be independently controlled as described above. Therefore, the temperature can be controlled at the secondary transfer portion T2 to be a lowest temperature necessary for stable heat transferring of a full-color toner image while preventing a temperature rise in the photosensitive member 11. Further, temperature can be controlled at the transfer-fixing portion T3 to be a temperature that provides an efficient amount of heat to stably transfer and fix a toner image on various types of sheets such as thin or thick paper, and plain, coated, or emboss paper.

Further, as the second intermediate transfer member 35 is stretched around only two rollers, the length of the second intermediate transfer member 35 can be short. Accordingly, a temperature decrease in the second intermediate transfer member 35 due to a heat discharge caused by exposure to surrounding air can be reduced. As a result, a small amount of heat which is required to heat the second intermediate transfer member 35 when controlling temperature at the transfer-fixing portion T3, and energy consumed in heating can be reduced. Moreover, since time required to heat the second intermediate transfer member 35 becomes short, the image forming process can be performed at higher speed.

Conventionally, when power supplied to the image forming apparatus is momentarily switched off during image formation, high temperature members inside the image forming apparatus may cause the temperature of the photosensitive member 11 to rise. However, according to the present exemplary embodiment, since heat capacity of members on which the second intermediate transfer member 35 is stretched is small, the temperature rise in the photosensitive member 11 can be prevented.

As described above, according to the present exemplary embodiment, an optimum temperature control can be performed. However, it is extremely difficult to control temperature to be uniform at the secondary transfer portion T2 and the transfer-fixing portion T3 because of various disturbances that occur.

The first intermediate transfer member 17 and the second intermediate transfer member 35 expand and contract according to temperature, however, their heat expansion rates are different. Consequently, if the temperature is not uniform, the expansion/contraction rate is also not uniform. Therefore, a toner image formed on the first intermediate transfer member 17 or the second intermediate transfer member 35 nonuniformly expands and contracts according to the nonuniform expansion/contraction rate.

For example, suppose that a lattice image having a constant interval is formed on the first intermediate transfer member 17 when a surface temperature of the first intermediate transfer member is controlled at 35° C. at the primary transfer portion T1. If a pitch of a lattice interval is P1, a lattice image of pitch P1 is formed on the first intermediate transfer member 17 immediately after passing the primary transfer portion T1.

On the other hand, suppose that a surface temperature t2 of the first intermediate transfer member 17 at the secondary transfer portion T2 is 115° C. If a heat expansion coefficient of the first intermediate transfer member 17 is $\alpha 1$, an expansion/contraction rate 1 due to a temperature difference is given by $\beta 1=\alpha 1\times(t2-t1)$.

A heat expansion coefficient of polyimide used in the first intermediate transfer member 17 according to the present exemplary embodiment is approximately $\alpha 1=6.0E-5/°$ C. Thus, a lattice pitch P2 of a toner image at the secondary transfer portion T2 is given by $P2=(1+\beta 1)\times P1$, or $1.0048P1$.

Further, if a surface temperature t3 of the second intermediate transfer member 35 at the secondary transfer portion T2 is controlled at 135° C., the toner image is transferred at the secondary transfer portion T2 in its original size. Consequently, a lattice pitch P3 of the toner image on the second intermediate transfer member 35 at the secondary transfer portion T2 is given by $P3=P2=(1+\beta 1)\times P1$.

Suppose then that a surface temperature t4 of the second intermediate transfer member 35 at the transfer-fixing portion T3 is 165° C. If the heat expansion coefficient of the second intermediate transfer member 35 is $\alpha 2$, an expansion/contraction rate $\beta 2$ according to a temperature difference in the second intermediate transfer member 35 is given by $\beta 2=\alpha 2\times(t4-t2)$.

In a case where polyimide is also used in the second intermediate transfer member 35, $\alpha 2$ is approximately $\alpha 2=6.0E-5/°$ C. A lattice pitch P4 of a toner image at the transfer-fixing portion T3 is thus given by $P4=(1+\beta 2)\times P3$, or $1.0048P3$. Since $P3=P2$, $P4=1.0096P1$.

To be more specific, if P1 is 10 mm, P4 becomes 10.096 mm, and an image which is 0.096 mm larger than the original toner image per pitch is transferred and fixed onto a sheet P. That is, for example, an image position is displaced by 1.44 mm at positions that are 150 mm away, in terms of center spreading.

The above-described example supposes that the respective surface temperatures t1, t2, t3, t4 of the primary transfer portion T1, the secondary transfer portion T2, and the transfer-fixing portion T3 are each uniform. However, in practice, temperature unevenness appears in surface temperatures.

For example, an edge temperature rise in a main scanning direction is generated when a small-size sheet Ps is continuously passed. In such a case, heat is intensively lost from a portion in a surface of the second intermediate transfer member 35 that corresponds to a main scanning direction width of the sheet Ps at the transfer-fixing portion T3.

Figure 2:
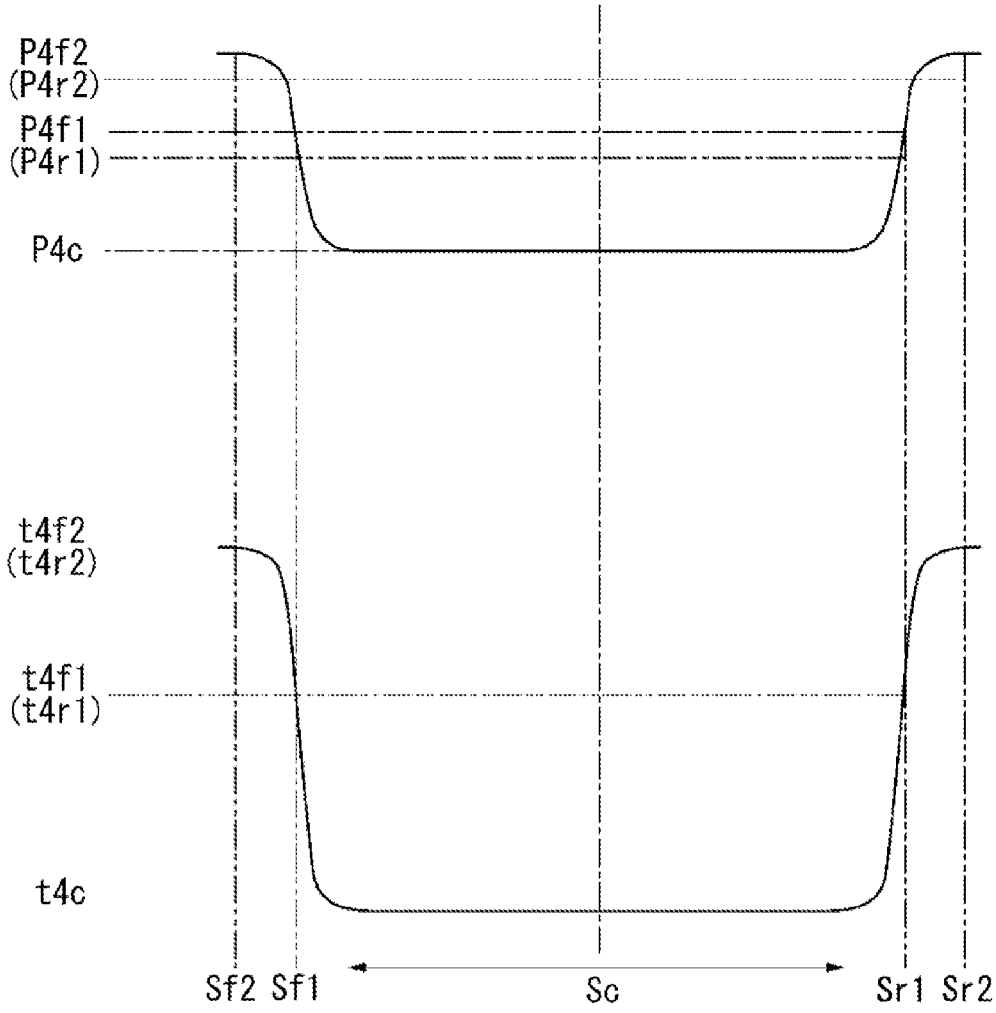
FIG. 2 is a graph illustrating temperature distribution and an image expansion/contraction amount in a main scanning direction of an intermediate transfer member according to an exemplary embodiment of the present invention.

The halogen lamp H is thus turned on and the transfer-fixing heating roller 31 is heated to compensate for the lost heat. As a result, there is an excessive temperature rise in a portion where the sheet Ps does not pass relative to the other portion, so that a temperature difference is generated, and a temperature is distributed as illustrated in FIG. 2. FIG. 2 shows a temperature difference in a main scanning direction (longitudinal direction) of the intermediate transfer member 35.

When a temperature difference is generated, a difference in the expansion/contraction rate is generated in the second intermediate transfer member 35 as described above. In such a state, if a sheet which is of a larger size than the small-sized sheet Ps is passed, an image whose magnification is different at an edge of the image is output.

Referring to FIG. 2, a region where a sheet passes on the intermediate transfer member 35 at the transfer-fixing portion T3 is indicated as Sc, and a surface temperature of the sheet-passing region Sc is t4*c*. In this case, surface temperature t4*f*1 and t4*f*2 at regions Sf1 and Sf2 that are outer edges in a longitudinal direction are higher than t4*c*.

If t4*c* and t4 are controlled to be equal, a lattice pitch P4*c* of a toner image at the sheet-passing region Sc is equal to P4.

However, the second intermediate transfer member 35 is locally expanded in the edge regions Sf1 and Sf2. Expansion/contraction rates $\beta 3$ and $\beta 4$ of the edge regions are each given by $\beta 3=\alpha 2\times(t4f1-t4)$ and $\beta 4=\alpha 2\times(t4f2-t4)$.

Therefore, a lattice pitch P4*f*1 in the edge region Sf1 and a lattice pitch P4*f*2 in the edge region Sf2 are given by $P4f1=(1+\beta 3)\times P4$ and $P4f2=(1+\beta 4)\times P4$ respectively.

In a case where t4*f*1 has become 180° C. and t4*f*2 has become 190° C., an image in P4*f*1 expands 1.009 times the size of the image at P4, and an image in P4*f*2 expands 1.015 times the size of the image at P4. If the sheet-passing region Sc is spread from the center, an image expansion/contraction similar to that described above occurs in symmetric regions Sr1, Sr2 on opposite sides in a main scanning direction as illustrated in FIG. 2.

In the present exemplary embodiment, the above-described temperature distribution is detected using a temperature sensor.

Referring to FIG. 1, a temperature sensor 50 is disposed opposite to the transfer-fixing-heating roller 31. A width of the temperature sensor 50 in the main scanning direction is similar to that of the second intermediate transfer member 35.

The temperature sensor 50 is a thermopile, noncontact temperature sensor. A plurality of sensor elements is disposed in a width direction of the second intermediate transfer member 35. Surface temperature of the second intermediate transfer member 35 can be thus measured at a plurality of locations in the width direction.

Figure 3:
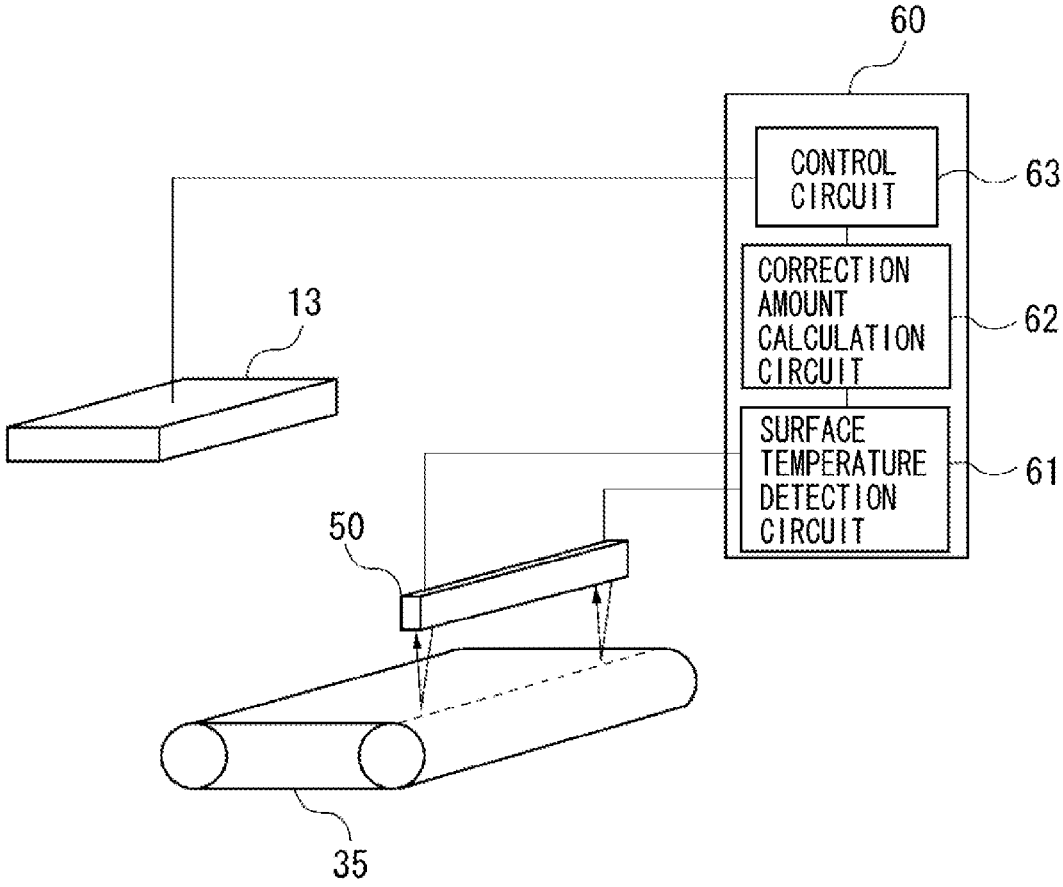
FIG. 3 is a block diagram illustrating a process for controlling an image magnification correction according to an exemplary embodiment of the present invention.

An image magnification correction process will be described below with reference to FIG. 3 and a flowchart illustrated in FIG. 4. FIG. 3 illustrates a block diagram for describing an image magnification correction process according to an exemplary embodiment of the present invention. Referring to FIG. 3, a central processing unit (CPU) 60 calculates an image expansion/contraction amount based on detection information acquired by the temperature sensor 50. The CPU 60 then corrects the expansion/contraction of the image by correcting timing of writing an image by the exposure device 13.

Figure 4:
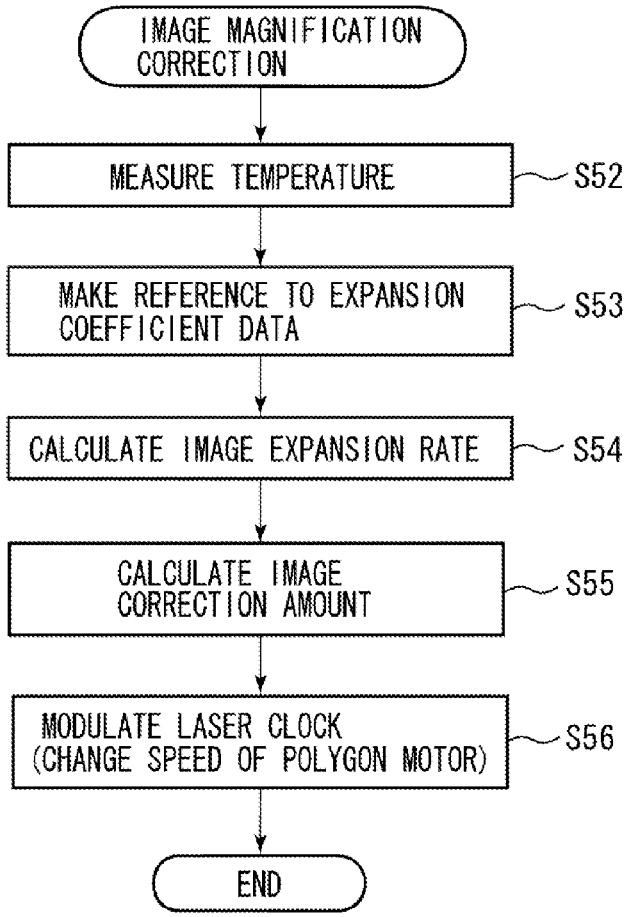
FIG. 4 is a flowchart illustrating a process for controlling image magnification correction according to an exemplary embodiment of the present invention.

FIG. 4 is a flowchart illustrating an image magnification correction control process according to an exemplary embodiment of the present invention. In step S52, a surface temperature detection circuit 61 illustrated in FIG. 3 measures a surface temperature of the second intermediate transfer member 35. Consequently, the surface temperature detection circuit 61 acquires surface temperature information for every point on the second intermediate transfer member 35 from the temperature sensor 50.

In step S53, a correction amount calculation circuit 62 illustrated in FIG. 3 makes reference to heat expansion coefficient data (e.g., $\alpha 2=6.0E-5/°$ C.) of the second intermediate transfer member 35 stored in a read-only memory (ROM, not illustrated).

In step S54, the correction amount calculation circuit 62 calculates the expansion amount at each point of a surface of the second intermediate transfer member 35. The expansion amount is equal to an expansion amount of a toner image on the second intermediate transfer member 35.

In step S55, the correction amount calculation circuit 62 calculates an image correction amount. The image correction amount is determined such that a portion of the image that is expanded in the edge of the second intermediate transfer member 35 at the transfer-fixing portion T3 is previously formed to be smaller at the primary transfer portion T1.

The above-described process will be described in detail with reference to the lattice image illustrated in FIG. 2.

Referring to FIG. 2, a lattice pitch of the above-described toner image is expanded and has become pitch P4*f*1 in the edge region Sf1. Consequently, an expansion rate $\gamma 1$ with respect to the lattice pitch P4 at the center sheet-passing region Sc is given by $\gamma 1=P4f1/P4$.

Similarly, a lattice pitch of the above-described toner image is expanded and has become pitch P4*f*2 in the edge region Sf2. Consequently, an expansion rate $\gamma 2$ with respect to the lattice pitch P4 at a region Sc at the center can be is given by $\gamma 2=P4f2/P4$.

Therefore, a correction amount Co1 for the region Sf1 and the correction amount Co2 for the region Sf2 are each a reciprocal of $\gamma 1$ and $\gamma 2$, i.e., $Co1=1/\gamma 1$ and $Co2=1/\gamma 2$.

According to the above description, the correction amount Co1 and Co2 can be calculated as shown below using the heat expansion coefficient $\alpha 2$ and surface temperatures t4, t4*f*1 and t4*f*2 at each region in the second intermediate transfer member 35.

$$Co1=1/(1+\alpha 2\times(t4f1-t4))$$

$$Co2=1/(1+\alpha 2\times(t4f2-t4))$$

An image which is smaller in size by amounts of the above-described correction amounts Co1 and Co2 is thus formed at the primary transfer portion T2.

That is, a toner image whose lattice pitches P4*f*1*c* and P4*f*2*c* are given by $P4f1c=Co1\times P1$, $P4f2c=Co2\times P1$, is formed at the primary transfer portion T1.

As a result, an image whose lattice pitch in the edge regions Sf1 and Sf2 are the same as the lattice pitch P4 at the center region Sc can be transferred and fixed.

In step S56 of the flowchart illustrated in FIG. 4, the correction amount calculated by the correction amount calculation circuit 62 is reflected in a modulation of the image writing clock (i.e., timing of laser emission) of the exposure device 13 by the control circuit 63 illustrated in FIG. 3.

Figure 5:
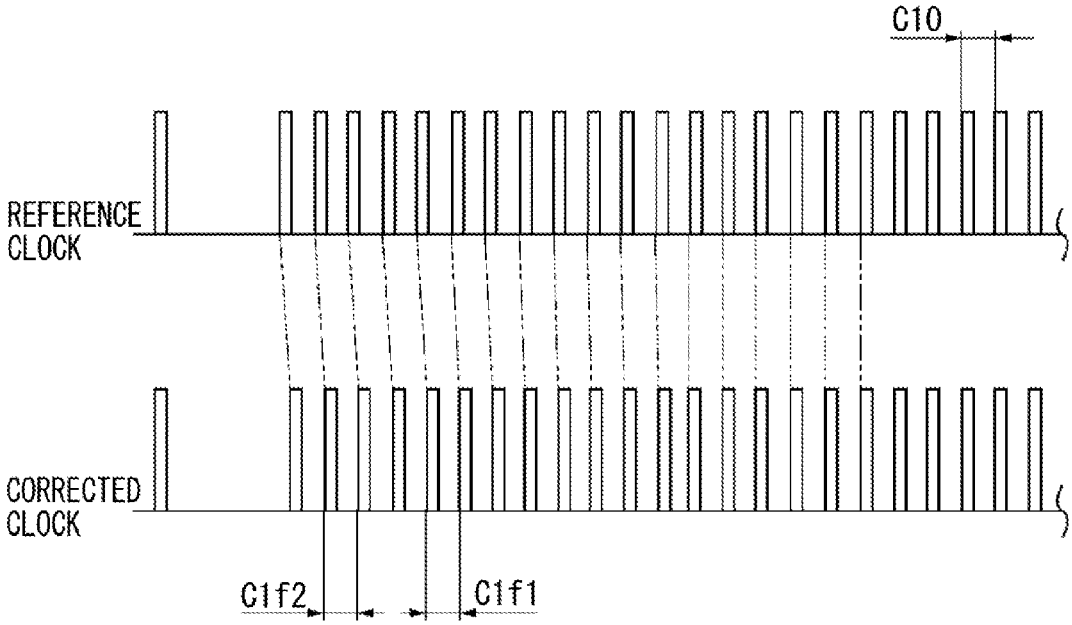
FIG. 5 is a diagram illustrating a reference clock and a clock after performing image magnification correction according to an exemplary embodiment of the present invention.

FIG. 5 is a diagram illustrating a reference clock and a clock after image magnification correction is performed according to an exemplary embodiment of the present invention. An upper portion of FIG. 5 illustrates how an image data is written according to a constant reference clock C10. In this state, the lattice pitch of a toner image at the primary transfer portion T1 is P1.

A lower portion of FIG. 5 illustrates an image data writing clock after performing correction. When clocks at positions that correspond to the edge regions Sf1, Sf2 are Clf1, Clf2 respectively, control is performed such that Clf1=Co1×C10 and Clf2=Co2×C10.

As a result, a toner image is formed in which lattice pitches of a toner image formed at the primary transfer portion T1 are pitches P4*f*1*c*, P4*f*2*c* respectively.

The temperature unevenness at the transfer-fixing portion T3 is always changing as time passes. Consequently, the above-described image magnification correction is continuously performed while a job is being executed.

For example, the above-described edge temperature rise is gradually resolved as the sheet P1 is passed. The difference between the surface temperature t4*c* of the sheet-passing region Sc and the surface temperatures t4*f*1, t4*f*2 of the edge regions Sf1, Sf2 is reduced, and an amount of image expansion and a necessary correction amount are also reduced.

Therefore, every time one or more pages of sheet P passes through the transfer-fixing portion T3, the CPU 60 measures the surface temperature of the second intermediate transfer member 35 using the surface temperature and using the surface temperature detection circuit 61. The CPU 60 then calculates a correction amount at the correction amount calculation circuit 62 and re-writes the correction amount at every measurement. The control circuit 63 then modulates the image writing clock according to the re-written correction amount.

Figure 6:
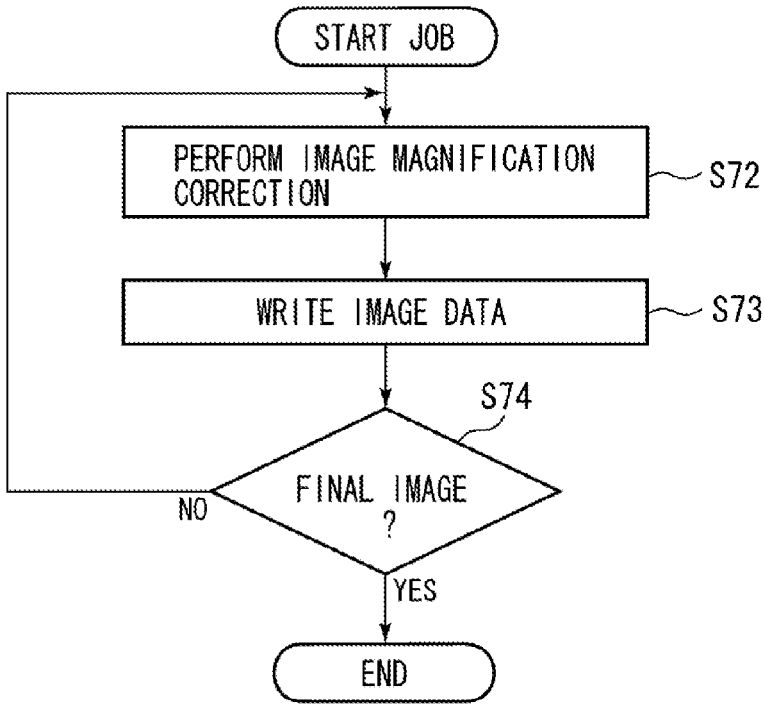
FIG. 6 is a flowchart illustrating a control process performed after the process for controlling image magnification correction is performed.

FIG. 6 is a flowchart illustrating a control process performed after an image magnification correction control process is performed. Referring to FIG. 6, a job is started and in step S72, the image magnification correction process illustrated in the flowchart of FIG. 4 is performed, so that a correction amount is calculated. In step S73, an image data is actually written with an image writing clock according to the correction amount, and a toner image is formed on the photosensitive member 11.

In step S74, it is determined whether the current image formation is final. If the written image is a final image (YES in step S74), the job ends. On the other hand, if the written image is not the final image (NO in step S74), the process returns to step S72, and the image magnification correction illustrated in FIG. 4 is performed to calculate a new correction amount.

After returning to step S72, in step S73, an image data is actually written with an image writing clock according to the new correction amount, and a toner image is again formed on the photosensitive member 11.

As described above, steps S72 to S74 illustrated in the flowchart of FIG. 6 are repeatedly performed until the final image is formed. As a result, a correction amount matching the latest temperature status is always calculated, and an image of an optimum image magnification can be formed.

According to the present exemplary embodiment, image expansion at an edge of the second intermediate transfer member 35 caused by a temperature rise at the transfer-fixing portion T3 is previously corrected. That is, an image which is smaller by the expansion amount is formed at the primary transfer portion T1, so that the expansion of the image can be cancelled out.

By performing the above-described process, a uniform image in which there is no local departure of image magnification (i.e., partial magnification departure) on a surface of a sheet P can be obtained.

In the above-described exemplary embodiment, an image is divided into regions Sc, Sf1, Sf2, etc., in FIG. 2, for ease of description. However, image magnification correction can be more uniformly performed by dividing an image more finely in a longitudinal direction.

Second Exemplary Embodiment

An image forming apparatus according to a second exemplary embodiment of the present invention will be described with reference to FIG. 7. Portions that overlap with or are equivalent to those described in the first exemplary embodiment will be described using the corresponding figures and reference numerals of the first exemplary embodiment.

In the first exemplary embodiment, image magnification correction is caused by temperature unevenness in the main scanning direction due to an edge temperature rise. However, as described above, the surface temperature at the transfer-fixing portion T3 is always changing as time passes. For example, if a sheet P starts to pass the second intermediate transfer member 35, the surface of the transfer member 35 loses heat to the sheet P at the transfer-fixing portion T3.

In order to compensate for the loss of heat amount, the halogen lamp H is switched on to heat the transfer-fixing heating roller 31. As a result, the transfer-fixing heating roller 31 recovers the temperature of the transfer-fixing portion T3. However, the temperature of the transfer-fixing heating roller 31 conversely becomes higher than a target temperature due to heat transfer speed and delay in performing control. Consequently, the halogen lamp H is turned off, and supplying of heat amount is suspended.

However, since the sheet P takes off a heat amount, the temperature again becomes lower than the target temperature. The halogen lamp H is thus again switched on. Such a process is repeated, so that the temperature of the transfer-fixing heating portion T3 is controlled to be within a predetermined error range of the target temperature.

Therefore, the surface temperature t4*c* of the center region Sc illustrated in FIG. 2 does not necessarily remain constant. As a result, the lattice pitch P4 of the toner image formed on the second intermediate transfer member 35 also changes.

To solve such a problem, the present exemplary embodiment performs control to correct an entire magnification in addition to a regional magnification.

Figure 7:
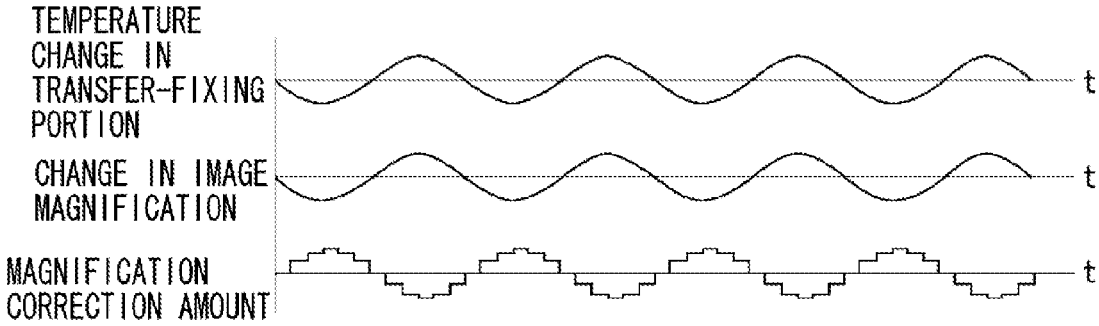
FIG. 7 is a graph illustrating a relation among a temperature change in a transfer-fixing portion, change in image magnification, and magnification correction amount in an image forming apparatus according to a second exemplary embodiment of the present invention.

FIG. 7 is a graph illustrating a relation between a temperature change in a transfer fixing portion, change in image magnification, and magnification correction amount in an image forming apparatus according to a second exemplary embodiment of the present invention. Referring to FIG. 7, the surface temperature at the transfer-fixing portion T3 changes as time passes as illustrated in the top portion of the graph. Simultaneously, the image magnification of the toner image formed on the second intermediate transfer member 35 changes according to the heat expansion coefficient $\alpha 2$ as illustrated in the middle portion of the graph.

Consequently, as in the first exemplary embodiment, an image is previously formed to be smaller by an expansion amount of image from a target size at the primary transfer portion T1. Alternatively, an image is previously formed to be larger by a contraction amount of image from a target size at the primary transfer portion T1.

If a target pitch of a toner image formed on the second intermediate transfer member 35 at the transfer-fixing portion T3 is P4*t*, P4*t* is realized when the surface temperature at the transfer-fixing portion T3 is a target temperature t4*t*.

When the surface temperature remains low at a temperature t41, a lattice pitch P41 is slightly smaller than the target pitch P4*t*. Referring to the flowchart illustrated in FIG. 4, in step S54, an expansion/contraction rate of pitch P41 with respect to the target pitch P4*t* is calculated.

Further, when the surface temperature remains high at a temperature t4*h*, a lattice pitch becomes P4*h* which is slightly larger than the target pitch P4*t*. Similar to the above, an expansion/contraction rate of pitch P4*h* with respect to the target pitch P4*t* is calculated in step S54 of the flowchart illustrated in FIG. 4. In step S55, the correction amount according to the expansion/contraction rate is then calculated.

Further, image magnification can be spatially and temporally corrected by calculating a correction amount for a surface temperature t4*n* of each of a plurality of positions in the main scanning direction. If a correction amount at a predetermined main scanning position at a predetermined time is Con, Con is calculated by $Con=1/(1+\alpha 2\times\times(t4n-t4))$.

In step S56 of the flowchart illustrated in FIG. 4, the image writing clock is then modulated according to the calculated correction amount, similar to the first exemplary embodiment.

That is, the control circuit 63 illustrated in FIG. 3 controls the exposure device 13 so that $Cln=Con\times C10$, wherein Cln is an image writing clock of a predetermined main-scanning position at a predetermined time.

As a result, a lattice pitch of a toner image formed on the second intermediate transfer member 35 at the transfer-fixing portion T3 becomes the target pitch P4*t*, and a toner image whose magnification in the main scanning direction is uniform can be obtained.

Similarly as in the main scanning direction, an image magnification change caused by expansion/contraction of the second intermediate transfer member 35 due to a temperature change is also generated in a sub-scanning direction.

In step S56 of the flowchart illustrated in FIG. 4, a rotational speed of a polygon motor (not illustrated) that rotatably drives the polygon mirror is changed to correct an image magnification change in the sub-scanning direction.

In such a case, it is necessary to determine one setting value of the rotational speed of the polygon motor for one toner image. Consequently, correction is performed using, for example, a temperature t4*m* which is an average value of surface temperature t4*n* of each of a plurality of positions in the main scanning direction.

That is, the temperature t4*m* is an average value of the surface temperature of the second intermediate transfer member 35 when temperature is measured in step S52 illustrated in FIG. 4. Correction of an image magnification departure in the sub-scanning direction caused by the difference between the average temperature t4*m* and the target temperature t4*t* is described below with reference to FIGS. 3 and 4.

When the average temperature t4*m* is lower than the target temperature t4*t*, a lattice pitch of a toner image on the second intermediate transfer member 35 at the transfer-fixing portion T3 becomes smaller than the target pitch P4*t*. Therefore, a rotation speed of the polygon motor is controlled to be slower, so that the toner image is previously formed to be larger at the primary transfer portion T1.

On the other hand, when the average temperature t4*m* is higher than the target temperature t4*t*, a lattice pitch of a toner image on the second intermediate transfer member 35 at the transfer-fixing portion T3 becomes larger than the target pitch P4*t*. Therefore, a rotation speed of the polygon motor is controlled to be faster, so that the toner image is previously formed to be smaller at the primary transfer portion T1.

Similar to the first exemplary embodiment, in step S55 of the flowchart illustrated in FIG. 4, the correction amount calculation circuit 62 illustrated in FIG. 3 calculates an image correction amount. If a correction amount at a predetermined time is Com, Com is calculated by $Com=1/(1+\alpha 2\times(t4m-t4))$.

In step S56, the control circuit 63 illustrated in FIG. 3 performs control, so that the rotational speed of the polygon motor is changed according to the correction amount calculated by the correction amount calculation circuit 62.

If a rotational speed of the polygon motor at a predetermined time is Vm, the control circuit 63 performs control so that $Vm=V0/Com$, wherein V0 is a reference rotational speed.

As described above, a lattice pitch of a toner image formed on the second intermediate transfer member 35 at the transfer-fixing portion T3 becomes the target pitch P4*t*. Therefore, a toner image whose magnification in the sub-scanning direction is also uniform can be obtained.

Third Exemplary Embodiment

An image forming apparatus according to a third exemplary embodiment of the present invention will be described with reference to FIGS. 8, 9, 10, 11, and 12. Portions that overlap with or are equivalent to those described in the first exemplary embodiment will be described using the corresponding figures and reference numerals of the first exemplary embodiment.

In the present exemplary embodiment, a toner mark image is formed on the second intermediate transfer member 35, and an image expansion rate is calculated by detecting the mark image.

Referring to FIG. 1, a line sensor 80 whose width in the main scanning direction is similar to that of the second intermediate transfer member 35 is disposed opposite to the transfer-fixing heating roller 31.

A plurality of light sources, e.g., an LED, and light-detecting elements for detecting reflected light of the light sources are disposed in the longitudinal direction via lenses in the line sensor 80. The line sensor 80 can thus detect mark images formed on the second intermediate transfer member 35 at a plurality of positions in the longitudinal direction.

Figure 11:
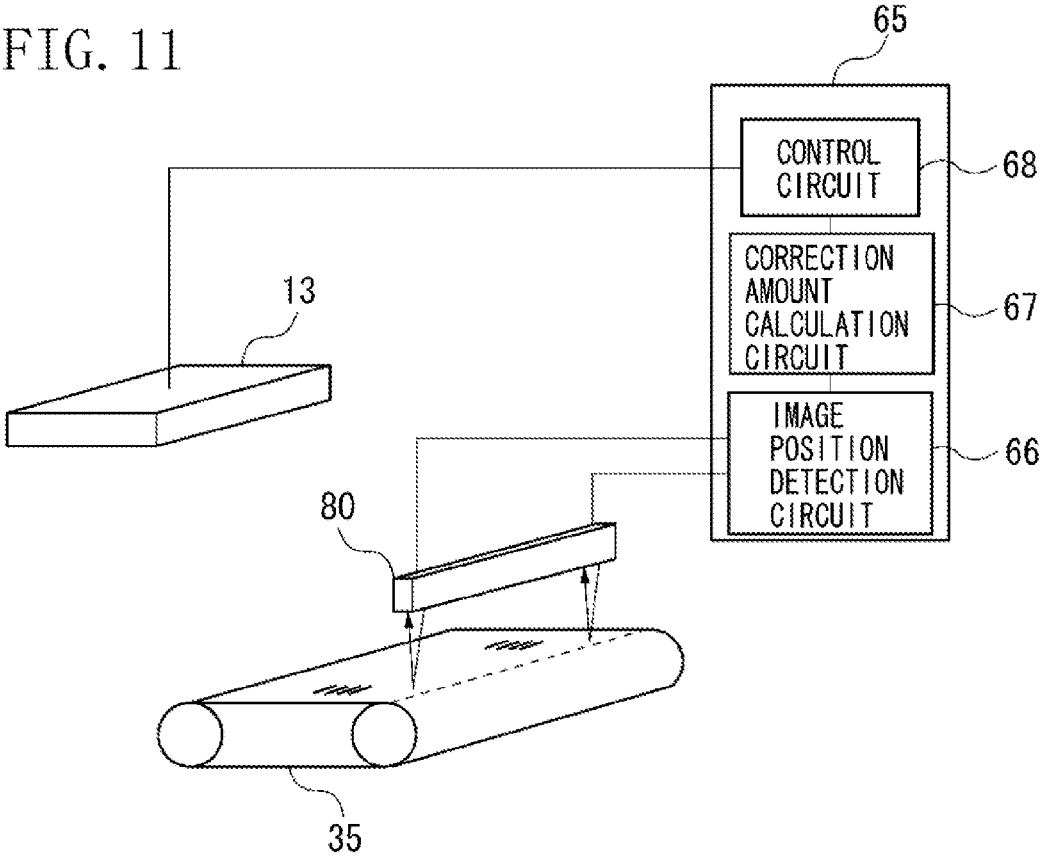
FIG. 11 is a block diagram illustrating a process for controlling image magnification correction according to the third exemplary embodiment of the present invention.

FIG. 11 illustrates a block diagram for describing an image magnification correction control process according to the third exemplary embodiment of the present invention. Referring to FIG. 11, a CPU 65 calculates an image expansion/contraction amount based on position information of the mark image. The CPU 65 then corrects the expansion/contraction of the image by performing image writing correction.

Figure 8:
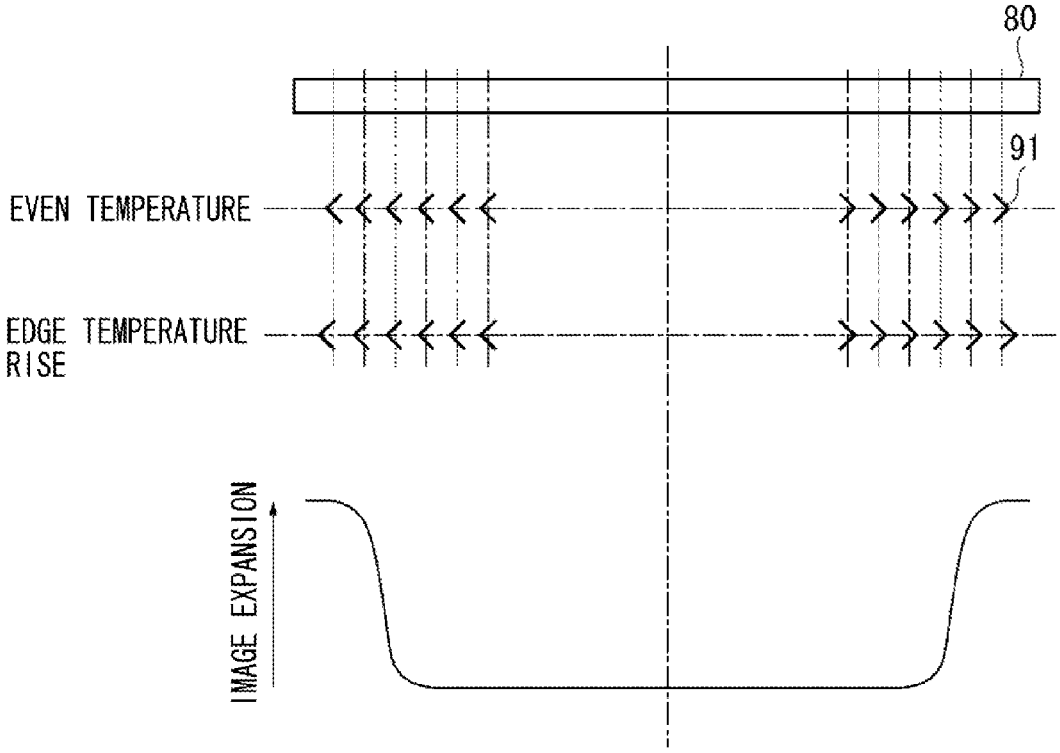
FIG. 8 illustrates an example of a mark image formed on a second intermediate transfer member in an image forming apparatus according to a third exemplary embodiment of the present invention.

FIG. 8 illustrates an example of a mark image formed on the second intermediate transfer member 35. Referring to FIG. 8, a plurality of V-shaped mark image 91 is formed in the main scanning direction on the second intermediate transfer member 35.

The mark image 91 is formed on the photosensitive member 11 by at least one of the image forming units Y, M, C, K. After the mark image 91 is transferred to the first intermediate transfer member 17 via the primary transfer portion T1, the mark image 91 is transferred to the second intermediate transfer member 35 via the secondary transfer portion T2.

Further, the mark image 91 is disposed at even intervals axisymmetric with respect to the center of the second intermediate transfer member 35, with apexes of the V-shape directed outward in the width direction.

Figure 9:
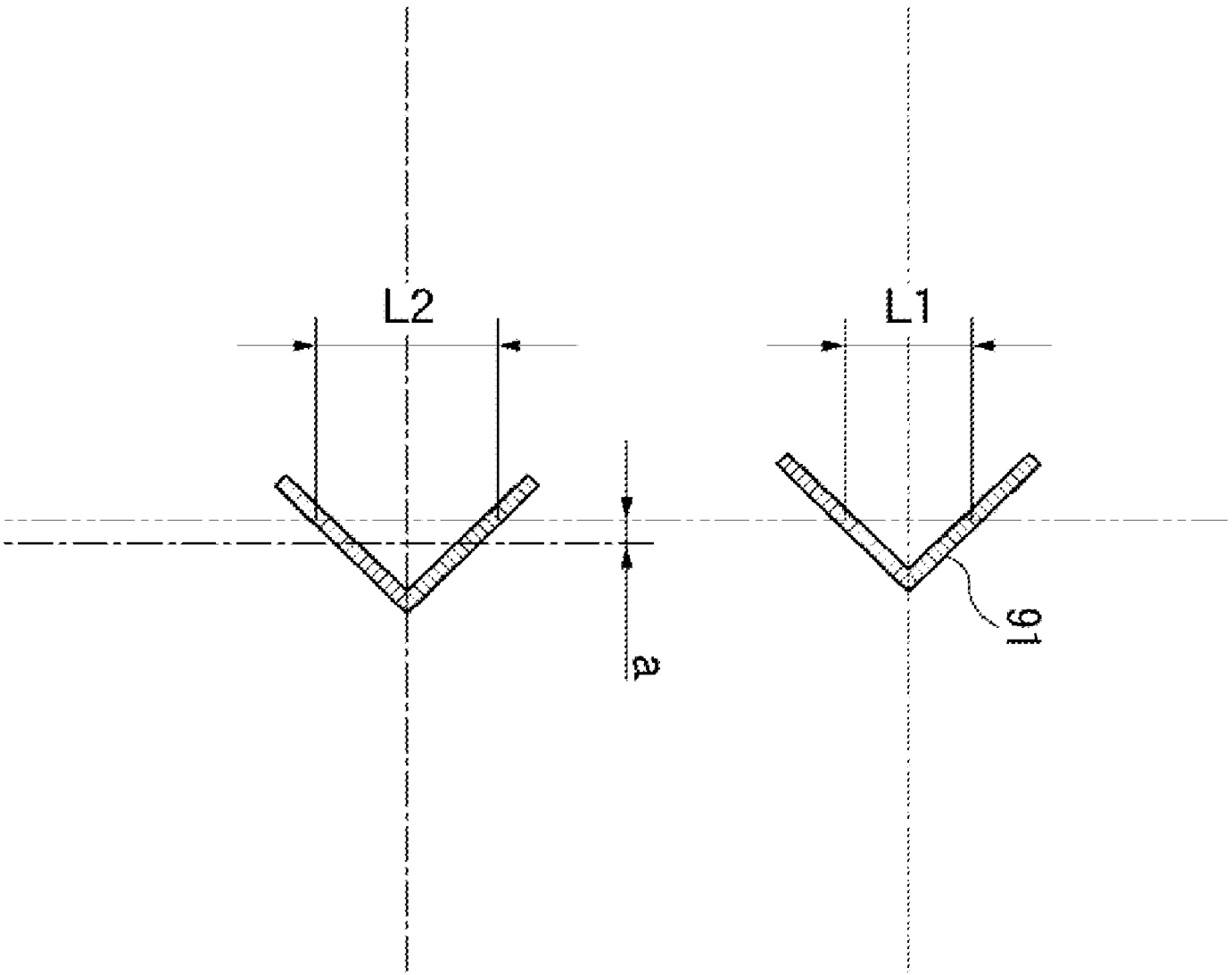
FIG. 9 illustrates in detail a mark image illustrated in FIG. 8 according to the third exemplary embodiment of the present invention.

When surface temperature of the second intermediate transfer member 35 is controlled to be uniform at a desired temperature, the mark image 91 is measured by the line sensor 80 to be positioned at even intervals. That is, a distance L1 between a first diagonal line and a second diagonal line in FIG. 9 is measured to be even in all mark images 91.

However, if an edge temperature rises as above described, an expansion rate increases at an edge of the second intermediate transfer member 35. Consequently, the mark image 91 formed near the edge is observed to be at a position deflected toward the edge. Referring to FIG. 9, when the mark image 91 is measured at a position which is a distance "a" away towards the outside, the distance between the first diagonal line and the second diagonal line is measured as L2.

The distance "a" which is obtained by a=(L2−L1)/2 corresponds to the expansion amount of the image at the measurement position. By correcting the distance "a", the image magnification can be corrected as in the first exemplary embodiment.

In the above case, distances L1 and L2 are measured for ease of description. However, in practice, time is measured and converted to distance as will be described below.

Figure 12:
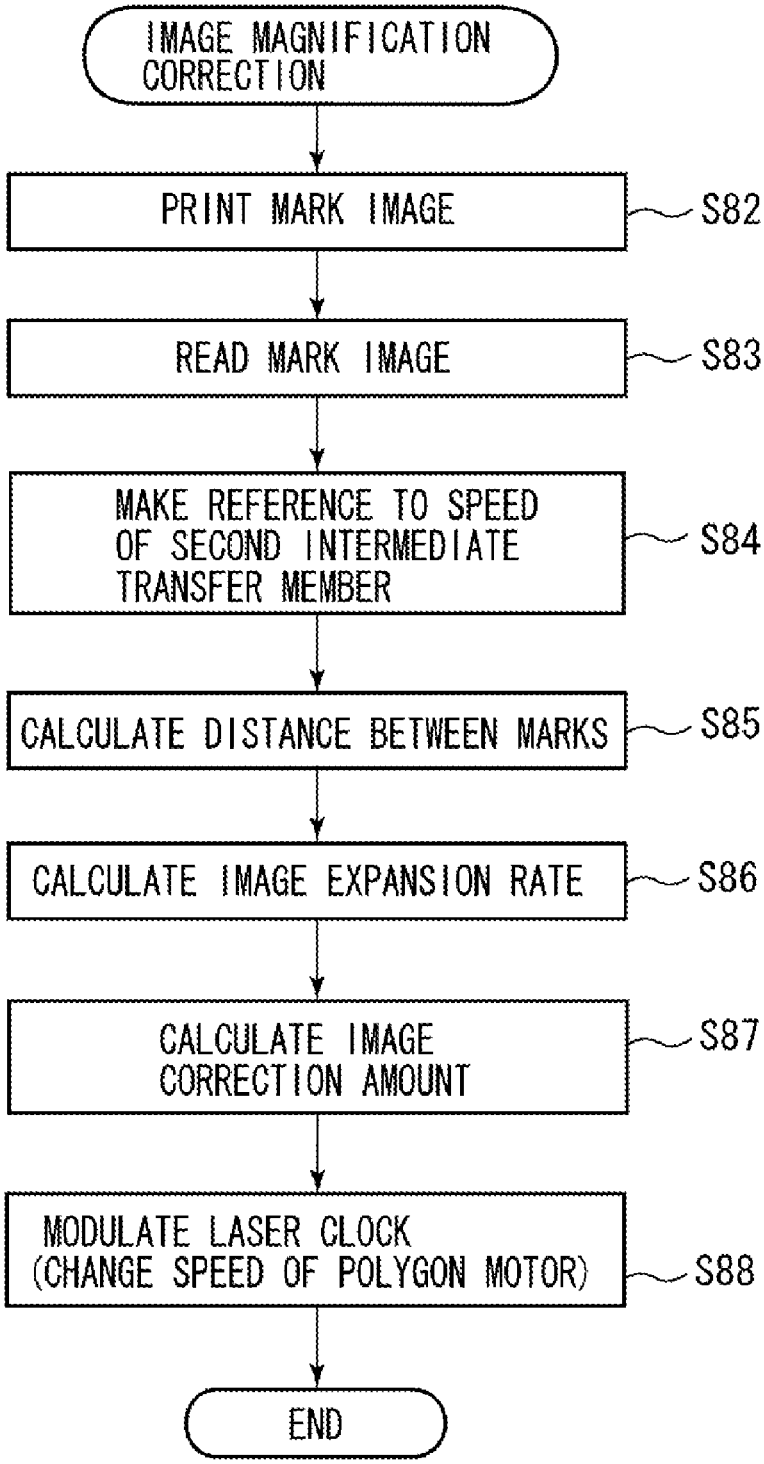
FIG. 12 is a flowchart illustrating the process for controlling image magnification correction according to the third exemplary embodiment of the present invention.

FIG. 12 is a flowchart illustrating an image magnification correction control process according to the present exemplary embodiment. In step S82, the mark image 91 is formed in a region between images, i.e., between paper sheets. In step S83, the line sensor 80 reads the mark image 91 and measures a time difference Δt between the first diagonal line and the second diagonal line. The line sensor 80 sends the time difference Δt to the image position detection circuit 66 in the CPU 65 illustrated in FIG. 11.

In step S84, the correction amount calculation circuit 67 illustrated in FIG. 11 makes reference to a circumferential velocity Vb of the surface of the second intermediate transfer member 35 stored in a ROM (not illustrated). In step S85, the correction amount calculation circuit 67 calculates a distance between marks L2 with L2=Δt×Vb.

In step S86, the correction amount calculation circuit 67 further calculates the distance "a" as an expansion amount as described above from the known distance L1. Since the distance "a" is the expansion amount from the distance L1, an expansion rate βa is calculated by βa=a/L1.

In step S87, the correction amount calculation circuit 67 calculates a correction amount Coa based on the expansion rate βa. Similar to the first exemplary embodiment, the correction amount Coa is given by Coa=1/(1+βa)=1/(1+a/L1).

In step S88, a control circuit 68 illustrated in FIG. 11 modulates the image writing clock of the laser scanner 13 (i.e., laser emitting timing) according to the correction amount Coa. In this case, control is performed so that Cla=Coa×C10, wherein Cla is a clock after correction, and Cl0 is a reference clock.

As described above, according to the present exemplary embodiment, a departure in image magnification is directly detected using the mark image 91 and a correction amount is calculated. The image writing clock is modulated based on the correction amount. As a result, a uniform image in which there is no local departure of image magnification (i.e., partial magnification departure) on a surface of a sheet P can be obtained.

Figure 10:
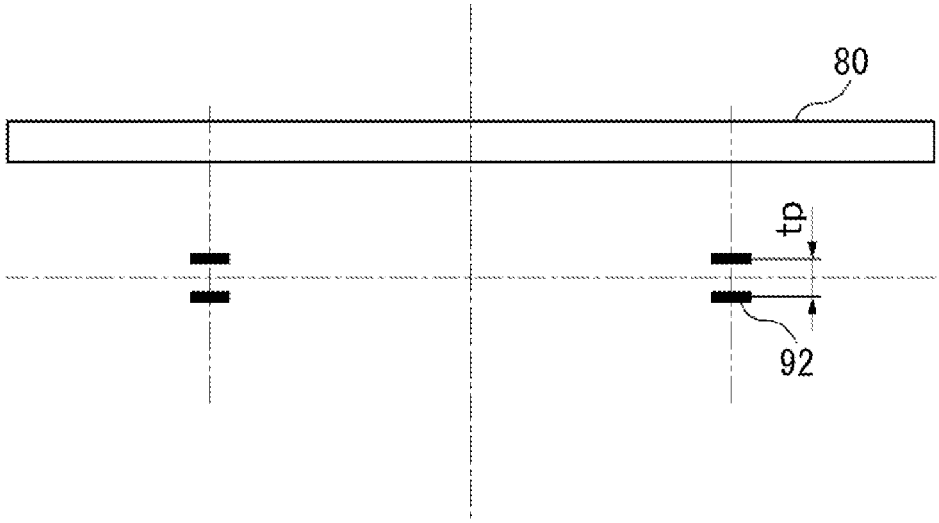
FIG. 10 illustrates an example of a mark image in a sub-scanning direction according to the third exemplary embodiment of the present invention.

As regards the sub-scanning direction, a mark image 92 illustrated in FIG. 10 is formed on the second intermediate transfer member 35 and detected by the line sensor 80. In step S88 of the flowchart illustrated in FIG. 12, image magnification is corrected by changing the rotational speed of the polygon motor (not illustrated) which drives the polygon mirror (not illustrated).

The mark image 92 consist of marks that are parallel drawn at a predetermined interval Lp and are disposed parallel to a conveying direction of the second intermediate transfer member 35. If expansion/contraction rate of the second intermediate transfer member 35 changes due to temperature change, the interval Lp changes accordingly. The interval Lp is then measured by the line sensor 80 and transmitted to the image position detection circuit 66 illustrated in FIG. 11.

Suppose that the interval Lp is measured by the line sensor 80 as time tp when surface temperature of the second intermediate transfer member 35 is uniformly controlled to be a desired temperature. If a temperature change causes the interval to be measured as time tb, the correction amount calculation circuit 67 illustrated in FIG. 11 calculates a correction amount Cop with Cop=1/(1+tb/tp) in step S87 of FIG. 12.

In step S88, the control circuit 68 illustrated in FIG. 11 changes the rotational speed of the polygon motor according to the correction amount calculated in step S87. If a rotational speed of the polygon motor at a predetermined time is Vb, control is performed so that Vb=V0/Cob, wherein V0 is a reference rotational speed.

As described above, according to the present exemplary embodiment, a departure in image magnification is detected using the mark image 92. A correction amount is then calculated, and a rotational speed of the polygon motor is changed according to the correction amount. As a result, a uniform image in which there is no local departure of image magnification (i.e., partial magnification departure) on a surface of a sheet P can be obtained.

Further, similar to the first exemplary embodiment, the above-described image magnification correction is always performed while a job is being executed, by forming mark image 91 and 92 between papers on the second intermediate transfer member 35.

Fourth Exemplary Embodiment

An image forming apparatus according to a fourth exemplary embodiment of the present invention will be described with reference to FIG. 13. Portions that overlap with or are equivalent to those described in the first exemplary embodiment will not be described.

The present exemplary embodiment describes an example in which image magnification in a surface of a resulting sheet P is more precisely corrected in consideration of contraction of the sheet P due to heat.

Figure 13:
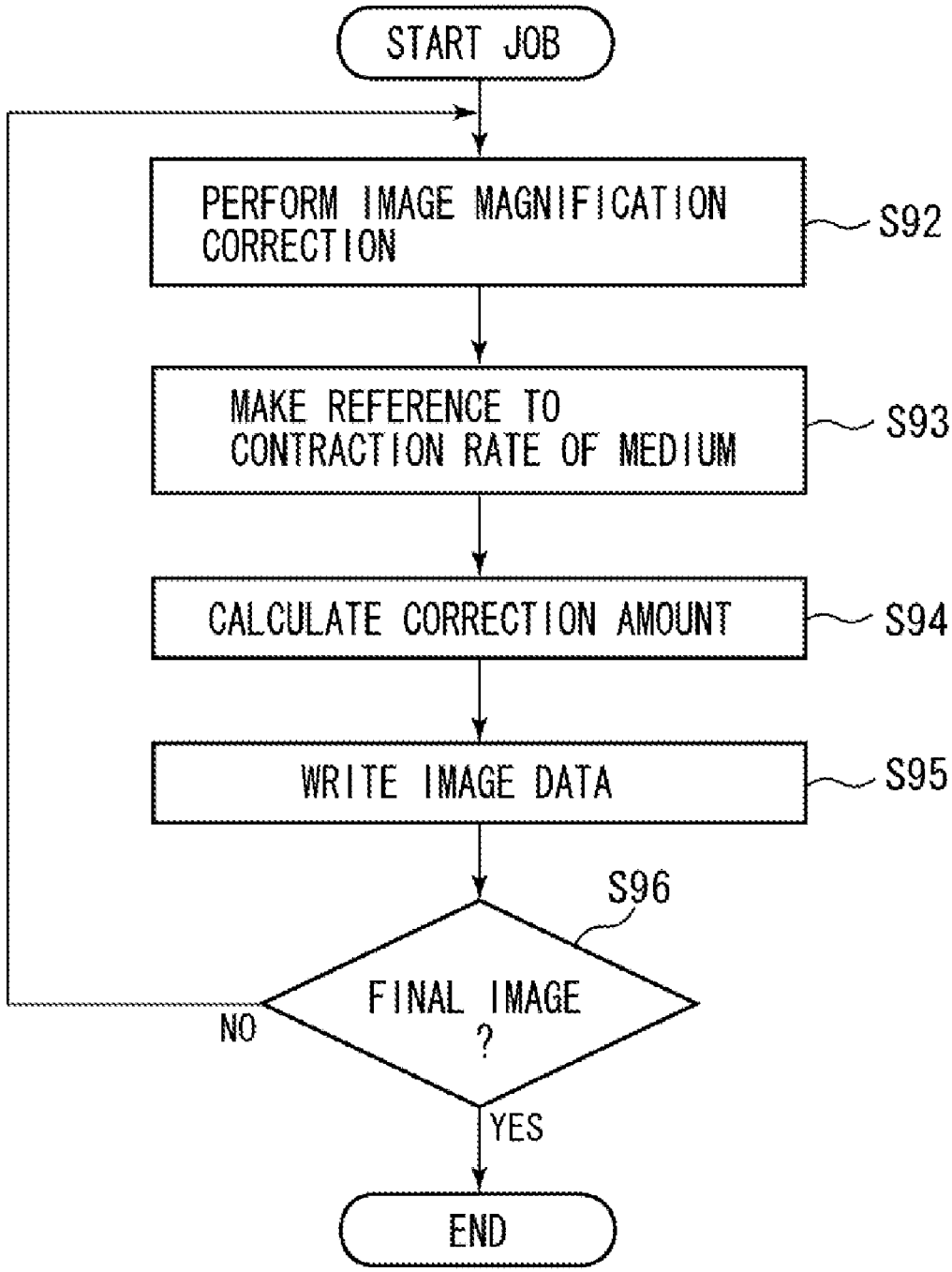
FIG. 13 is a flowchart of a process performed by an image forming apparatus according to a fourth exemplary embodiment of the present invention.

FIG. 13 is a flowchart of a process performed by an image forming apparatus according to the present exemplary embodiment. When a job starts, in step S92, image magnification correction is performed and a correction amount Co is calculated, similarly as in the first exemplary embodiment. In step S93, reference is made to a contraction rate q which is a rate of contraction caused by heat. Contraction rates q of various media (i.e., types of sheets) are stored in a ROM (not illustrated).

In step S94, a correction amount Coq which takes into account the contraction rate q with respect to the calculated correction rate Co is calculated. As in the first exemplary embodiment, the correction amount Coq is calculated as to the main scanning direction and the sub-scanning direction.

In step S95, image data is actually written based on an image writing clock and a rotational speed of the polygon motor according to the correction amount Coq and a toner image is formed on the photosensitive member 11.

In step S96, it is determined whether the present image formation is final. If the image is a final image (YES in step S96), the job ends. On the other hand, if the image is not a final image (NO in step S96), the process returns to step S92, and the above-described image magnification correction is again performed to calculate a new correction amount.

As described above, according to the present exemplary embodiment, steps S92 to S96 are repeatedly performed until the final image is formed. Accordingly, a correction amount that matches the latest temperature status is always calculated, so that an image of an optimum image magnification is written.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2007-180974 filed Jul. 10, 2007, which is hereby incorporated by reference herein in its entirety.

What is claimed is:

1. An image forming apparatus comprising:

a light source unit;

an image carrier on which a latent image is formed by a light beam emitted from a light source;

a developing unit configured to develop the latent image formed on the image carrier using a toner;

an intermediate transfer unit on which a toner image developed by the developing unit is transferred;

a heating unit configured to heat the intermediate transfer unit on which the toner image is transferred;

a fixing unit configured to fix the toner image heated by the heating unit on a recording medium;

a temperature detection unit configured to detect temperatures of the intermediate transfer unit at a plurality of positions in a width direction; and a control unit configured to control magnifications of a plurality of image regions in a latent image to be formed on the image carrier based on the detected temperatures at the plurality of positions.

2. The image forming apparatus according to claim 1, wherein the control unit controls the magnification of the latent image to be formed on the image carrier by changing timing of image formation on the image carrier performed by the light source unit.

3. The image forming apparatus according to claim 1, wherein the control unit controls the magnifications of the plurality of image regions in a latent image based on the detected temperatures at the plurality of positions and a heat expansion coefficient of the intermediate transfer unit.

4. The image forming apparatus according to claim 1, wherein the plurality of positions in the width direction includes a position of a sheet-passing region and a position of an outer edge region in the intermediate transfer unit, and wherein the control unit determines the magnification corresponding to the position of the outer edge region based on the temperature at the position of the sheet-passing region and the temperature at the position of the outer edge region.

5. The image forming apparatus according to claim 1, wherein the control unit controls a magnification of the plurality of image regions in the latent image to be formed on the image carrier based on the detected temperatures at the plurality of positions and a target temperature.

6. The image forming apparatus according to claim 1, wherein the control unit controls a first magnifications of the plurality of image regions in the latent image in a main scanning direction based on the detected temperatures at the plurality of positions and the target temperature and a second magnification of the latent image in a sub scanning direction based on temperatures calculated from the detected temperatures at the plurality of positions and the target temperature.

* * * * *